United States Patent [19]

Orth

[11] Patent Number: 4,937,991

[45] Date of Patent: Jul. 3, 1990

[54] FLASHING UNIT FOR SEALING ROOF PENETRATIONS

[76] Inventor: Michael J. Orth, 1375 NE. 134 St., N. Miami, Fla. 33161

[21] Appl. No.: 345,700

[22] Filed: May 1, 1989

[51] Int. Cl.[5] ..... E04B 7/00

[52] U.S. Cl. ..... 52/199; 52/60; 52/219; 285/42; 138/157

[58] Field of Search ..... 52/60, 199, 219, 218, 52/574; 285/42; 98/42.22; 138/157

[56] References Cited

U.S. PATENT DOCUMENTS

| | | | |
|---|---|---|---|
| 256,060 | 4/1882 | Seagrave et al. | 138/157 |
| 775,562 | 11/1904 | Golliek | 138/157 X |
| 1,399,748 | 12/1921 | Cheney | 285/42 X |
| 3,363,369 | 10/1965 | Miller | 52/60 |
| 4,570,396 | 2/1986 | Struber | 52/199 X |

*Primary Examiner*—Carl D. Friedman
*Assistant Examiner*—Linda J. Hoffert

[57] ABSTRACT

An improved flashing unit for use in weatherproofing a roof penetration including complimentary mating half portions of generally regid, high-strength sheet material, each half portion comprising a base plate, a generally semi-cylindrical stack portion attached to and extending upwardly from the base plate, each base plate having an upwardly directed generally semi-cylindrical flanged edge disposed within the lower end of each semi-cylindrical stack portion, a longitudinal edge portion of each stack portion forming an elongated continuous channel for receipt of a corresponding smooth longitudinal edge of the opposite stack portion for snap-fit frictional retention of the two stack portions when mated with the edge portions of the base plates in abutment, lap plates attached to abutting edge portions of the base plates to be received in lapping relation with an abutting side edge portion of the opposing base plate, and a generally cylindrical counterflashing, or cap, for surrounding a roof penetration and receiving the upper end portion of the mated stack portions in radially inwardly spaced relation therefrom. The flashing unit may also serve as a roof vent.

7 Claims, 2 Drawing Sheets

FLASHING UNIT FOR SEALING ROOF PENETRATIONS

The present invention is directed to a flashing unit for use to weatherproof pipes and other penetrations through a building roof, and, more particularly, to a flashing unit to weatherproof roof penetrations which may be mass-prefabricated at a manufacturing location, delivered to a construction site, and quickly and easily installed in a building construction by construction personnel.

BACKGROUND OF THE INVENTION

Flashing is widely employed in the building industry to weatherproof building roof constructions at their various juncture points with other components, such as vertical walls, and around roof penetrations, such as pipes, support beams, support rods, and the like, which extend through the roof.

Flashing for pipes and other roof penetrations typically are composed of thin sheet metal, which is cut and formed into the desired shape by construction workers at the building site, and fitted about the roof penetration to seal the opening of the roof between the penetration and the roof. For flat roofs, the flashing typically may consist of a base plate of sheet metal having a central opening. The base plate lies flat on and surrounds the opening in the roof. An upstanding, cylindrical hollow sleeve, or stack, surrounds the base plate opening, is secured thereto, and projects upwardly a distance above the roof line in surrounding relation to the pipe penetrating the roof. The stack is spaced outwardly from the pipe penetration a sufficient distance to permit relative movement between the penetration and roof construction. A cap, or counter flashing, is mounted in water-tight surrounding relation on the roof penetration, and overlies the upper end of the flashing stack to provide a weatherproof cover for the upper end of the stack.

Generally, in such sheet metal flashing constructions, the base plate is split to its central opening to facilitate its placement about the roof penetration, and the stack of the flashing is formed of a single flexible sheet of metal which is bent around the roof penetration into a cylindrical shape and soldered along its longitudinal seam to seal the same. The lower end of the stack is soldered to base plate and tabs located around its central opening. The counterflashing, or cap, of the flashing unit is generally a longitudinally split hollow sleeve of sheet metal of larger diameter than the stack, and is opened to encircle the protrusion and the upper end of the flashing stack. The counter flashing is secured to the roof penetration by suitable means, such as an internal gasket, sealant, and clamps.

In fabricating sheet metal flashings on site, even though architecturally specified, construction workers often may be inexperienced in properly sizing, cutting, and shaping the sheet metal stock material to the proper dimensions to effectively seal piping and other penetrations through the roof of the building. In addition, on-site flashing construction and fabrication results in increased labor and time for construction personnel.

It is also known to employ prefabricated flashing units made of a rigid plastic with an elastomeric covering material. One such prefabricated flashing unit is disclosed in U. S. Pat. No. 4,211,423, and consists of a multipart generally cylindrical unit with base flange and boot or cap of varying diameter stack, which may be height cut to provide a desired diameter to accommodate pipe of corresponding diameter. As disclosed in the patent, the roof seal device appears to be composed of multiple inner and outer sections which must be precisely aligned and secured with clamps and adhesively sealed at overlapping elastomeric portions resulting in what would appear to be a labor-intensive installation.

Prefabricated plastic flashings are also known which consist of a flexible longitudinally split generally cylindrical sleeve which is distorted to be brought around a roof penetration and thereafter secured along the split by screws and suitable clamping means.

It is generally believed that plastic and rubber flashing units have less resistance to UV light and weathering during use, and do not have the durability and use life of the sheet metal flashings.

BRIEF OBJECTS OF THE PRESENT INVENTION

It is an object of the present invention to provide an improved flashing unit to effectively weatherproof penetrations through building constructions, particularly pipe and other penetrations through the roof of a building.

It is another object to provide an improved flashing unit for weatherproofing penetrations through building roofs which also serves as a roof vent for air passage therethrough.

It is a further object to provide a flashing unit of relatively simplified construction which may be mass prefabricated at an off-site manufacturing location, economically delivered, and easily and quickly installed by construction personnel to weatherproof openings around roof penetrations of a building.

It is a more specific object to provide an improved light-weight, sheet metal flashing unit which may be prefabricated at an off-site location, and readily snap-fit installed around existing roof penetrations, such as pipes, by construction personnel to effectively weatherproof the roof openings around the same.

BRIEF DESCRIPTION OF THE DRAWINGS

The above, as well as other objects of the present invention, will become more apparent, and the invention will be better understood, from a detailed description of preferred embodiments thereof, when taken together with accompanying drawings, in which.

DETAILED DESCRIPTION OF PREFERRED EMBODIMENTS

Figure 1:
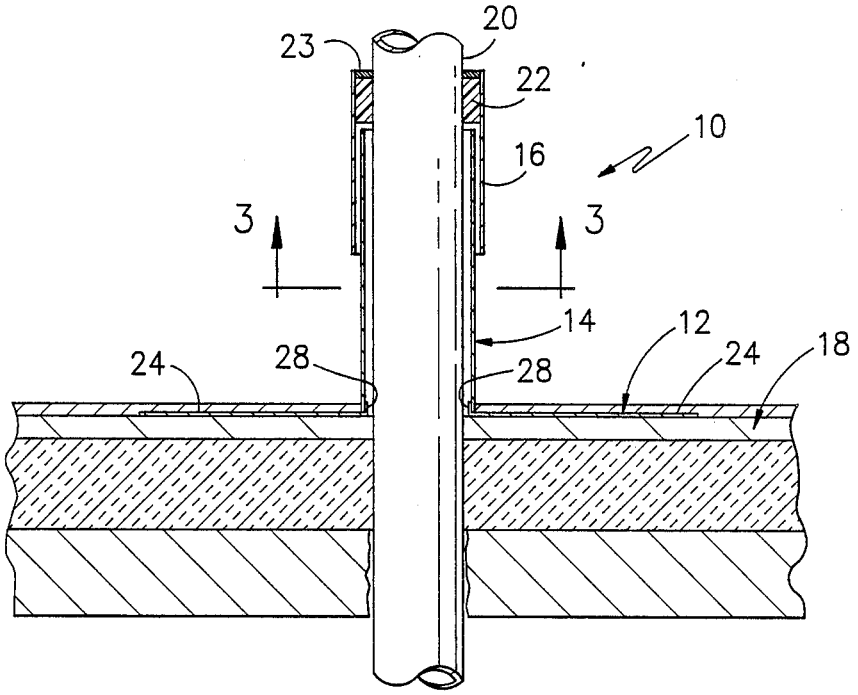
FIG. 1 is a sectional elevation view of an improved flashing unit of the present invention, showing it in relation to its installation in a roof construction to weatherproof a penetration therethrough.

Referring more particularly to the drawings, the improved flashing unit 10 of the present invention employed for sealing penetrations through building constructions, particularly pipe and other protrusions through the flat roof of a building, generally includes a support base 12 of generally rectangular, e.g., square, shape having radial corners, an up-standing stack 14, and a counter flashing, or cap, 16. As seen in FIG. 1, the support base 12 is placed in supporting contact on a horizontal surface portion of a roof structure 18 to which the flashing is to be attached, and the stack 14 surrounds a roof protrusion, or pipe 20, in spaced relation thereto, to permit relative movement between the pipe 20 and the roof structure 18. Surrounding an upper portion of the pipe 20, and sealingly secured thereto by a suitable flexible gasket 22 and sealing material 23, is the short, cylindrical counterflashing, or cap 16, which has an internal diameter greater than the external diameter of the stack 14. The lower end of cap 16 surrounds the upper end of stack 14 in radially outward spaced relation therefrom and provides a weatherproof cover to prevent rain water and other material from falling into the open space between the interior diameter of the stack 14 and the outer diameter of the pipe 20.

Figure 2:
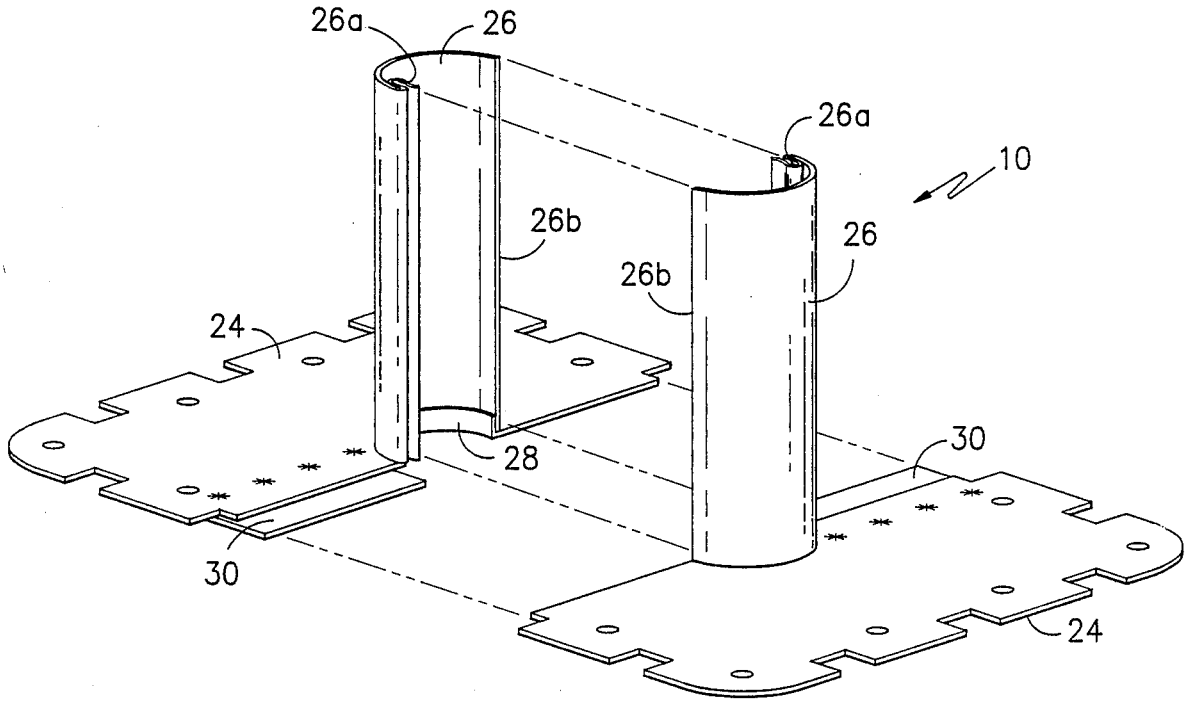
FIG. 2 is an enlarged exploded perspective view of the base plate and stack portions of the flashing unit of FIG. 1, showing the component parts thereof in separated relation to better illustrate the construction and assembly of the component parts thereof.

As best shown in FIG. 2, the flashing unit of the present invention, in its pre-installed configuration, includes two prefabricated complementary halves, each comprising a base plate portion 24 and a generally semi-cylindrical up-standing stack portion 26, formed of a suitable material, preferably a thin sheet of stainless steel.

The base plate portions 24 are provided with a central semi-circular edge portion along their opposed side edges. Each semi-circular edge has an up-turned, short, semi-cylindrical flanged edge 28 which may be suitably formed thereon, as by metal deforming of the base plate. Preferably, the flange of the two base plate halves may be formed by mandrel deformation of an opening through a single sheet of metal, which is then cut to form the two base plate halves.

Figure 3:
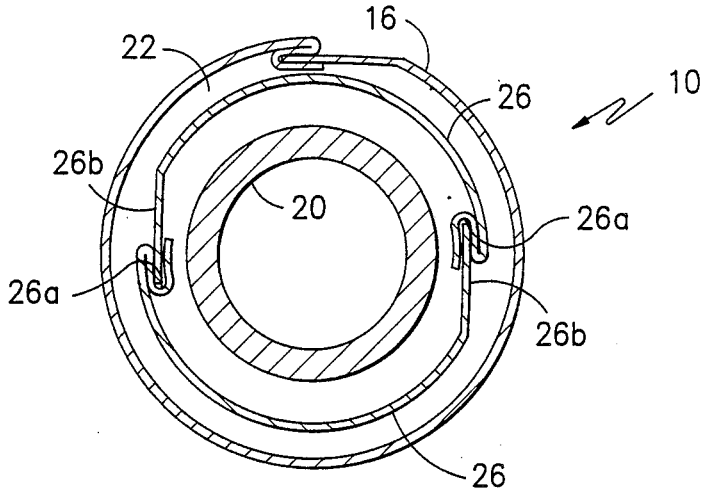
FIG. 3 an enlarged horizontal cross-sectional view of a portion of the stack of the unit, taken generally along line 111—111 of FIG. 1, and looking in the direction of the arrows.

Each semi-cylindrical stack portion 26 of the unit surrounds and is attached to the base plate portion 24 and its up-standing flange 28, as by spot-welding in the prefabricating operation. As seen in FIGS. 2 and 3, one full longitudinal edge of each semi-cylindrical stack portion 26 is bent by suitable sheet metal shaping equipment to form an elongated channel 26*a* for frictional receipt of an opposite, straight longitudinal edge 26*b* of the opposing stack portion when the two halves of the unit are snap-fit together to surround a roof penetration, e.g., pipe 20, at the building site location. The two halves of the stack are thus effectively secured together along their opposite longitudinal side edges, when the unit is installed.

Referring to FIG. 2, the abutting edges of the base plate portions 24 are provided with lap plate sections 30. As shown, one side edge portion of the abutting edges of each base plate portion 24 is provided with a short lap plate 30 which may be spot-welded to the underside of the base plate portions, so that the two lap plates 30 underlap the opposing side edge of the opposite base plate portion when the two halves of the unit are installed about the roof projection.

Figure 4:
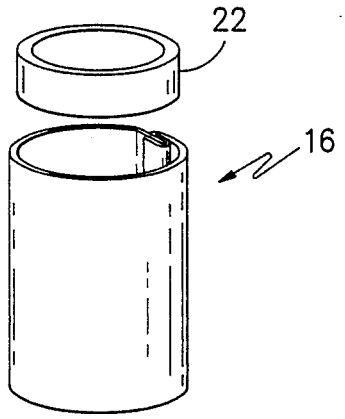
FIG. 4 an exploded view of counterflashing employed as a cap for the stack of the flashing unit of FIG. 1.

As best seen in FIG. 4, the counterflashing 24 for the unit of the present invention may be composed of a suitable material, such as thin sheet metal which is formed with a longitudinal channel along one side edge, rolled into a hollow cylinder and secured along its edges, as by soldering or the like. Gasket 22 of suitable material, such as a self-adhering, 1" wide closed cell foam, may be placed on the pipe 20 ⅛" to 3/16" above the top of stack 14 and the counterflashing, or cap 16, located therearound. The top of the counterflashing 16 is located approximately ⅛" to 3/7" above the top edge of the gasket to form an open top pocket into which a sealant material 23, such as a gunable grade single part urethane sealant, may be applied in on-site installation. As seen in FIG. 1, the unit, when installed, is placed in closely surrounding relation with a roof opening on the roof support surface, with the counterflashing 16 being secured in sealing engagement directly to a penetration through the roof.

The prefabricated half sections of the present invention may be readily snap-fit around roof protrusions during installation, without the need for bending or deforming the halves of the base plate or stack during installation. It can be appreciated that the base plate may be of substantial horizontal dimension to insure full cover of the roof for a considerable distance away from the roof opening through which the penetration extends, thereby providing improved weatherproof seal and structural support of the stack of the unit on the roof support of the building.

Typically, the prefabricated flashing unit of the present invention may be readily assembled at a central off-site manufacturing location, with the semi-cylindrical stack portions 14 spot-welded to their respective base plate flange portions 28, thus providing a base and stack of two-piece prefabricated construction. The counterflashing 16 may be formed of a single split-cylinder of sheet metal, opened to surround the upper portion of the stack and roof protrusion, and thereafter soldered or sealed at the juncture of the edges of the cap 16. The longitudinal seams and the bottom edges of the stack portions 14 may be soldered after assembly on site to seal the seams and the bottom edges to the base plates. The sheet metal base plates may be coated or laminated with a suitable material or substance compatible with the applied roof membrane surface or composition to facilitate seal of the same thereto, e.g., polyvinyl chloride.

Another important feature of the flashing unit construction of the present invention is that it may serve as a roof vent, as well as weatherproof a roof penetration of a building. As seen in FIG. 1, the counterflashing or cap 16 of the flashing unit surrounds the upper portion of stack 14 radially outward and vertically upward spaced relation of the stack to provide a passageway for air flow and venting of the roof, allowing moisture from the roof substrate to vent between the stack and the counterflashing. This construction effectively reduces the number of conventional roof vents which otherwise might be required for the building.

As can be appreciated, the size of the flashing units of the present invention will vary in diameter to accommodate the particular size roof penetrations to be sealed. A typical prefabrication may be formed with a cylindrical stack about 9" high. The base plate and flange portions may be formed by cutting a hole in the center of a single piece of sheet metal ½" smaller than the stack diameter and extruding the peripheral edges of the hole ¼" upward at a 90° angle to match the internal diameter of the stack. The sheet is then cut into equal halves to form the two portions 24. The base plates preferably are dimensioned to extend horizontally at least about 4" from the stack in all directions with 1½" radial corners. The counterflashing, or cap, is preferably a minimum of 5" high with about 3¾" overlap of the stack flashing. The stack may be sized to fit individual pipe or other roof penetrations with a ⅛" minimum clearance in any direction for movement. The flashing sheet material preferably is formed of stainless steel, such as a Type 304-2B-26 gauge (0.018 in.) ASTM A167, Fed. Spec. QQ-S-766.

Although it is preferred that the flashing unit of the present invention be constructed of a durable, thin, sheet metal material, such as stainless steel, it may be constructed of a suitable rigid high-strength plastic.

That which is claimed is:

1. An improved prefabricated flashing unit for use in weatherproofing roof penetrations including a pair of complementary mating half portions of generally rigid, high-strength sheet material, each half portion comprising a base plate and generally semi-cylindrical stack portion attached to and extending upwardly from an edge portion of each base plate, each base plate having an upwardly directed generally semi-cylindrical flanged edge disposed within the lower end of each semi-cylindrical stack portion in engagement with the lower edge portion of the stack portion, means securing each stack portion to its base plate, one longitudinal edge portion of each stack portion forming an elongated continuous channel for receipt of the corresponding smooth longitudinal edge of the opposite stack portion to provide snap-fit frictional retention of the two stack portions when mated with the edge portions of the base plates in abutment, and means operatively attached to the abutting edges of the base plates to lap the same and facilitate seal and strength of the unit when in mating relation.

2. A flashing unit as defined in claim 1 wherein said operatively attached means comprises a lap plate attached to an abutting edge portion of each base plate on one side so as to be received in lapped relation with the other abutting side edge portion of the opposing base plate.

3. A flashing unit as defined in claim 1 further including a counterflashing of generally hollow cylindrical shape having a longitudinal split therealong, one longitudinal edge of the split forming a continuous channel for receipt of the other longitudinal edge of the counterflashing in frictional engagement therewith, the counterflashing being dimensioned so as to receive the upper end of the assembled stack portions in radially inward spaced relation therefrom, and sealing means for securing and sealing the upper end portion of the counterflashing to a roof protrusion extending therethrough.

4. A flashing unit as defined in claim 1 wherein the base plate and stack portions are formed of a thin, rigid, high-strength metal, and the semi-cylindrical stacks of each half portion are secured to their base plate by welding.

5. A flashing unit as defined in claim 1 wherein each base plate is of generally rectangular configuration and extends for at least about 4" radially outwardly of the stack portion.

6. A flashing unit as defined in claim 1 comprising means on each base plate to facilitate securement of the base plate to a roof construction.

7. A flashing unit as defined in claim 1 further including a counterflashing of generally hollow cylindrical shape for surrounding, in sealing engagement, a penetration of a building roof, said counterflashing being dimensioned to receive the upper end of a portion of the assembled stack portions in radially outward and vertically upward spaced relation therefrom to provide a passageway for venting a roof opening about which the unit is placed.

* * * * *

UNITED STATES PATENT AND TRADEMARK OFFICE

CERTIFICATE OF CORRECTION

PATENT NO. : 4,937,991
DATED : July 3, 1990
INVENTOR(S) : Michael J. Orth

It is certified that error appears in the above-identified patent and that said Letters Patent is hereby corrected as shown below:

In the Abstract, line 3, "regid" should be -- rigid --.

In the Specification:

Column 2, line 64, "111—111" should be -- 3—3 --.

Column 4, line 9, "3/7"" should be -- 3/16" --.

Signed and Sealed this

Tenth Day of December, 1991

*Attest:*

HARRY F. MANBECK, JR.

*Attesting Officer*

*Commissioner of Patents and Trademarks*